US008282082B2

(12) United States Patent
An

(10) Patent No.: US 8,282,082 B2
(45) Date of Patent: Oct. 9, 2012

(54) IMPACT ABSORBING BARRIER ASSEMBLY

(75) Inventor: Eun-Hee An, Jeonju-si (KR)

(73) Assignee: ET Industry Co., Ltd., Jeonbuk (KR)

( * ) Notice: Subject to any disclaimer, the term of this patent is extended or adjusted under 35 U.S.C. 154(b) by 171 days.

(21) Appl. No.: 12/673,674

(22) PCT Filed: Sep. 19, 2008

(86) PCT No.: PCT/KR2008/005534

§ 371 (c)(1),
(2), (4) Date: Feb. 16, 2010

(87) PCT Pub. No.: WO2009/064073

PCT Pub. Date: May 22, 2009

(65) Prior Publication Data

US 2011/0127479 A1 Jun. 2, 2011

(30) Foreign Application Priority Data

Nov. 12, 2007 (KR) ..... 10-2007-0114859

(51) Int. Cl.
*E01F 15/00* (2006.01)

(52) U.S. Cl. ..... 256/13.1; 256/65.03

(58) Field of Classification Search ..... 256/13.1, 256/65.03, 65.08, 65.07; 403/254, 257, 259; 248/548, 615, 636, 218.4; 52/655.1
See application file for complete search history.

(56) References Cited

U.S. PATENT DOCUMENTS 3,416,484 A * 12/1968 Chapman ..... 116/67 R
3,776,520 A * 12/1973 Charles et al. ..... 256/13.1
4,183,505 A * 1/1980 Maestri ..... 256/13.1
5,234,280 A * 8/1993 Cowan ..... 404/6
5,549,279 A 8/1996 Aszkenas
6,220,576 B1 * 4/2001 Chan ..... 256/13.1
6,520,711 B2 * 2/2003 Kim ..... 404/6
7,726,632 B2 * 6/2010 Amengual Pericas ..... 256/13.1

FOREIGN PATENT DOCUMENTS

JP 1996-113924 A 5/1996
KR 100293065 B1 3/2001

* cited by examiner

*Primary Examiner* — Victor MacArthur
*Assistant Examiner* — Daniel Wiley
(74) *Attorney, Agent, or Firm* — Jefferson IP Law, LLP

(57) ABSTRACT

Disclosed is an impact absorbing barrier assembly. The assembly includes a support having a pipe configuration and installed at the center line or the side of a road, an impact absorbing cylinder combined to the support and including a cylinder having a penetrating through-hole and being made by using one of ethylene vinyl acetate (EVA) and soft polyurethane, and including a rotation support pipe corresponding to the outside circumference of the support and inserted into the through-hole, a fence guide horizontally installed at upper and lower portions of the impact absorbing cylinder and at front and rear portions of the support to connect the supports, a fence guide combining device, and a rotation support device to support the rotation of the impact absorbing cylinder. The impact from a car collision with the impact absorbing barrier assembly may be reduced.

12 Claims, 12 Drawing Sheets

IMPACT ABSORBING BARRIER ASSEMBLY

TECHNICAL FIELD

The present invention relates to an impact absorbing barrier assembly, and more particularly, to an impact absorbing barrier assembly, installed at the center or side of a road to spatially separate traffic flow moving either in the same direction or opposite directions in dangerous areas involving high numbers of traffic accidents and requiring drivers to pay careful attention, the impact absorbing barrier assembly being capable of reducing the impact from a car collision with the barrier assembly, preventing the car from crossing into oncoming lanes or leaving the road, and returning the car to a normal forward direction.

BACKGROUND ART

Generally, an automobile is used as a transportation means, and the purpose is to bring convenience to users. Nowadays, the relative importance of the automobile is gradually increasing as an essential necessity for social life as well as daily life beyond the level of the mere transportation means.

As described above, the number of automobiles in South Korea is continuously increasing and has already exceeded about 10 million, in line with the social development. Considering the number of the automobiles, South Korea can be regarded as a developed country. However, a shameful statistic is that the number of automobile accidents based on the population is the highest in the world. In particular, because a median barrier or a protective barrier at the side of a road (which will be hereinafter referred to as a protective barrier) is rarely installed on roads in South Korea, drivers always travel with a higher risk of being in an accident.

Meanwhile, protective barriers are classified into a fixed type, which is installed on the center line or at the side of the road, and a buried type, which is buried at the center line or at the side of the road. The fixed type includes concrete blocks, installed on the center line or at the side of the road. The fixed type is constructed by connecting the blocks one by one and then fixing them on the center line or at the side of the road using bolts.

However, the above-described fixed type of the protective barrier installed on the center line or the side of the road cannot absorb the impact from a car collision, but merely prevents intrusion of a car into the oncoming lanes or a car from leaving the road. Accordingly, the impact from a car collision is wholly transferred to the car, causing damage to the car in addition to injury or death.

For the buried type of the protective barrier, which is buried at the center line or at the side of the road, the following structure can be presented as an example. A pillar is buried at the center line or at the side of the road, and then a guide rail or a fence having a predetermined waveform is fixed to the pillar at both sides or one side of the pillar by using nuts and bolts. Then, a plurality of waste tires is installed at the pillar to reduce the impact from a car collision.

According to the above-described buried-type protective barrier buried at the center line or the side of the road, the impact from a car collision can be absorbed by the protective barrier and be dispersed to reduce the scale of the accident and to reduce injuries or deaths. However, the velocity of the car may not be reduced because of the rotational power of the waste tires, but instantly increased to induce deviation of the car from the driving lane. This problem may cause a secondary collision with a car traveling in an adjacent lane to generate a serious traffic accident.

In addition, since the structure of the protective barrier of the buried type at the center line or the side of the road is very complicated, the manufacturing cost may be increased and the assembly time of the components at the construction site may be lengthened. Particularly, when a car collision occurs at a place where the front car cannot be observed due to road conditions, such as a curved road or an uphill road, other cars might travel without recognizing the accident to induce a more serious accident.

In order to solve the above-described problem, the Applicant of the present invention filed Utility Model Application No. 2005-13826 on May 17, 2005 in the Korean Intellectual Property Office (KIPO) with the title of "Median Strip for Shock Absorber." This utility model was registered on Jul. 28, 2005 as Utility Model No. 391872. According to this utility model, the impact absorbing body of the median strip for a shock absorber was manufactured by using a synthetic resin, and thus there was a problem in that the impact absorbing body typically broke into pieces due to the impact from a car collision.

DISCLOSURE OF THE INVENTION

Technical Problem

The present invention has been proposed in order to solve the problems of the conventional method, that is, to provide an impact absorbing barrier assembly to reduce the impact of a car collision with the impact absorbing barrier assembly and to prevent intrusion of a car into oncoming lanes beyond the center line of a road or a car from leaving the road after a car collision, as well as to return the car to a normal forward direction, thereby minimizing the possibility of a serious accident.

Another object of the present invention is to provide a road barrier assembly having a structure for reducing the impact from a car collision and for preventing intrusion of a car into oncoming lanes over the center line or a car from leaving the road, and returning the car along the direction of travel, thereby minimizing the possibility of a serious accident and reducing injuries, deaths, and damage to property.

Further another object of the present invention is to provide an impact absorbing cylinder made by using ethylene vinyl acetate (EVA) or soft polyurethane having excellent recovery characteristics and elasticity, and thus the impact from a car collision may be absorbed and reduced by the impact absorbing cylinder. Because of the excellent recovery characteristics and the elasticity of EVA and soft polyurethane, breaking of the impact absorbing cylinder from a car collision may be prevented.

Further, since the protective barrier may be manufactured as a prefabricated structure, a damaged portion after a car collision with the protective barrier may be easily replaced according to the present invention to facilitate the management of the protective barrier.

Technical Solution

Accordingly, the present invention is provided to substantially obviate one or more problems due to limitations and disadvantages of the related art.

An impact absorbing barrier assembly includes a support having a pipe configuration and installed upright at the center line or the side of a road at constant intervals; an impact absorbing cylinder rotationally combined to the support and including a cylinder having a through-hole penetrating the cylinder from an upper portion to a bottom portion thereof and being made by using one of EVA and soft polyurethane, and including a rotation support pipe having a pipe configuration corresponding to the outer circumference of the support and inserted into the through-hole of the cylinder by force; a fence guide horizontally installed at upper and lower portions of the impact absorbing cylinder and at front and rear portions of the support to connect the supports while supporting the impact absorbing cylinder and preventing separation of the impact absorbing cylinder; a fence guide combining device for combining the fence guide at the front and rear portions of the support; a rotation support device of the impact absorbing cylinder, inserted onto the outer circumference of the support between the fence guide and the impact absorbing cylinder to support rotation of the impact absorbing cylinder; and an end cap screwed to the upper end portion of the support for closing the upper end portion of the support.

According to the impact absorbing barrier assembly having the above-described configuration, the cross-section of the fence guide has a semicircle configuration and a long bolt insertion groove is formed along a central line of a plane facing the support. Both long end portions are separated at constant intervals and bent inwardly.

Meanwhile, the fence guide combining device includes a fence guide support member including a combining plate having a combining hole at a center portion thereof and having a predetermined length to combine the fence guide support member to both sides of the support through a bolt nut member, and the fence guide support member including a support plate having a cantilever shape and formed at both sides of the combining plate in one body, a bolt combining hole being formed at each support plate; a bolt support plate having a configuration of covering both inner end portions of the fence guide and having a bolt insertion hole at the surface corresponding to the bolt insertion groove of the fence guide; a fence guide combining bolt combined through the bolt insertion hole of the bolt support plate and the bolt combining hole formed on the support plate of the fence guide support member at an inner portion of the fence guide; and a fence guide combining nut for fixing the fence guide onto the fence guide support member by screwing onto the fence guide combining bolt penetrating into the inner portion of the support plate of the fence guide support member.

The bolt insertion hole of the bolt support plate may have a square shape corresponding to the bolt insertion groove of the fence guide.

In addition, a rotation preventing combining member having a square shape is further provided at a lower portion of a bolt head of the fence guide combining bolt corresponding to the fence guide bolt insertion groove, thereby preventing rotation through a rotation preventing function with the bolt insertion groove through combining with the fence guide combining nut.

Further, an edge cut may be formed at each edge portion of the rotation preventing combining member of the fence guide combining bolt so that the fence guide combining bolt may be easily screwed through the bolt insertion hole of the bolt support plate.

Meanwhile, one or a plurality of the impact absorbing cylinders having different heights may be rotationally combined to the one support.

Here, the fence guide is installed at upper and lower portions of the impact absorbing cylinder when one impact absorbing cylinder is installed, while the fence guide is installed at upper, middle and lower portions of the support when the plurality of the impact absorbing cylinders having different sizes is installed, to separate the impact absorbing cylinders from each other.

In addition, a fence guide reinforcing member may be provided at a center portion of the fence guide between two supports to reinforce the connection of the facing fence guides, the fence guide reinforcing member having a hexahedron shape corresponding to an interval between the facing fence guides, and a bolt combining opening being formed at each side facing the fence guide for combining using the fence guide combining device inserted into the bolt combining opening of the fence guide reinforcing member through the bolt insertion groove of the fence guide.

Additionally, a high-luminance reflective sheet is provided on an outer surface of the impact absorbing cylinder for better visibility of a traffic lane through light reflection at night.

The impact absorbing cylinder may be made by adding a fluorescent material into one of EVA (ethylene vinyl acetate) and soft polyurethane material to emit light at night.

The rotation support device of the impact absorbing cylinder may be one of a plurality of rings and bearings, rotationally combined on an outer surface of the support.

The rotation support pipe of the impact absorbing cylinder may include an outer rotation support pipe and an inner rotation support pipe, the inner rotation support pipe being rotationally installed with respect to the outer rotation support pipe.

Advantageous Effects

According to the protective barrier assembly of the present invention, the impact generated from a car collision with the protective barrier may be reduced and intrusion of a car over the center line or a car leaving the road may be prevented. In addition, the car may be returned to a normal forward direction to minimize the possibility of a serious accident.

Further, injuries, deaths and car damage may be minimized by minimizing the possibility of a serious accident by providing the protective barrier assembly according to the present invention. The impact generated during a car collision with the protective barrier may be reduced and the intrusion of a car over the center line or a car leaving the road may be prevented. In addition, the direction of travel of the car may be returned to a normal forward direction.

Because an impact absorbing cylinder for absorbing the impact from a car collision and for reducing the impact is made by using EVA or soft polyurethane according to the present invention, breaking of the impact absorbing cylinder after a car collision may be prevented through the excellent recovery characteristics and elasticity of EVA and soft polyurethane.

In addition, since the protective barrier has a separable prefabricated structure according to the present invention, damaged portions due to the impact from the car collision may be easily replaced. Therefore, management of the protective barrier may become an easy task.

BRIEF DESCRIPTION OF THE DRAWINGS

The above and other advantages of the present invention will become more apparent by describing in detail example embodiments thereof with reference to the accompanying drawings, in which.

BEST MODE FOR CARRYING OUT THE INVENTION

Figure 1:
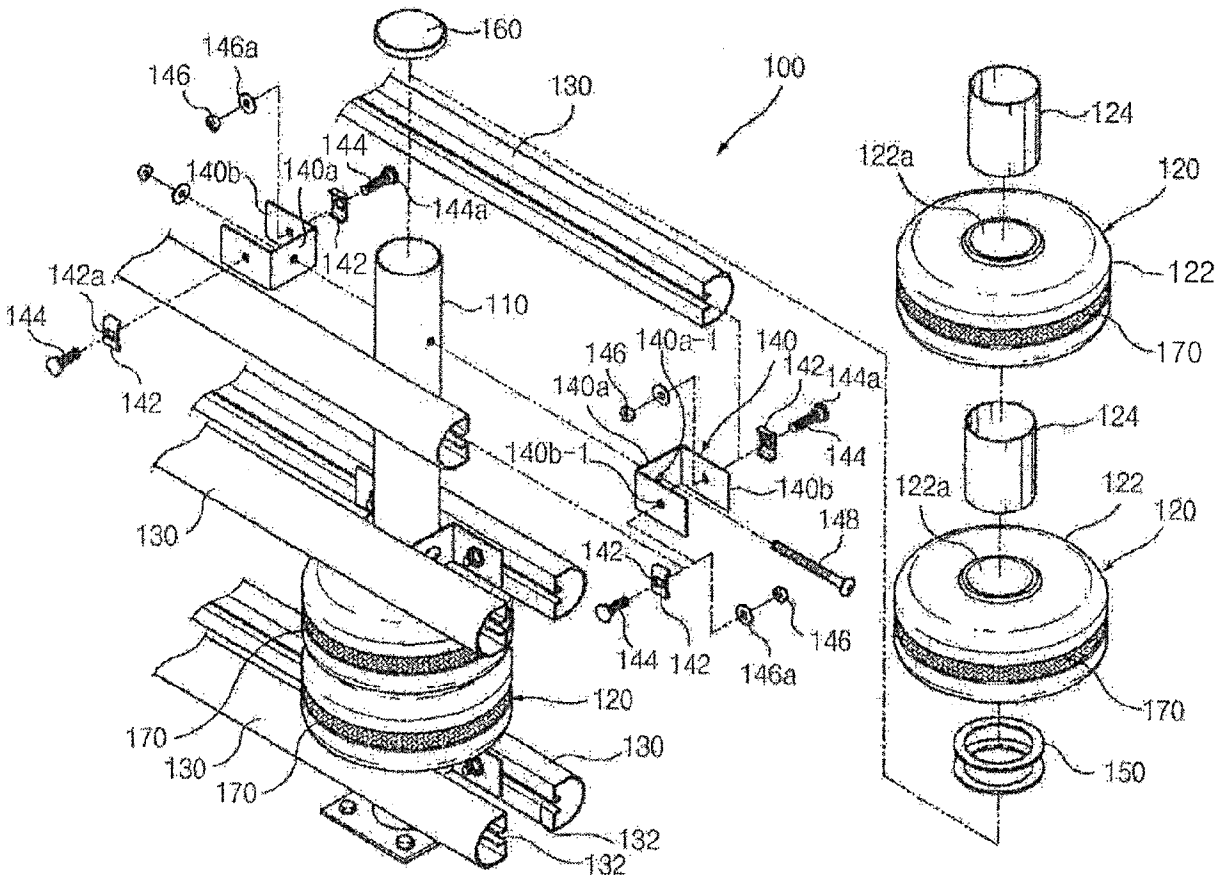
FIG. 1 is an exploded perspective view of the impact absorbing barrier assembly according to an embodiment of the present invention.

Embodiments of the present invention now will be described more fully with reference to the accompanying drawings, in which embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout this application.

It will be understood that, although the terms first, second, etc. may be used herein to describe various elements, these elements should not be limited by these terms. These terms are used to distinguish one element from another. For example, a first element could be termed a second element, and, similarly, a second element could be termed a first element, without departing from the scope of the present invention.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
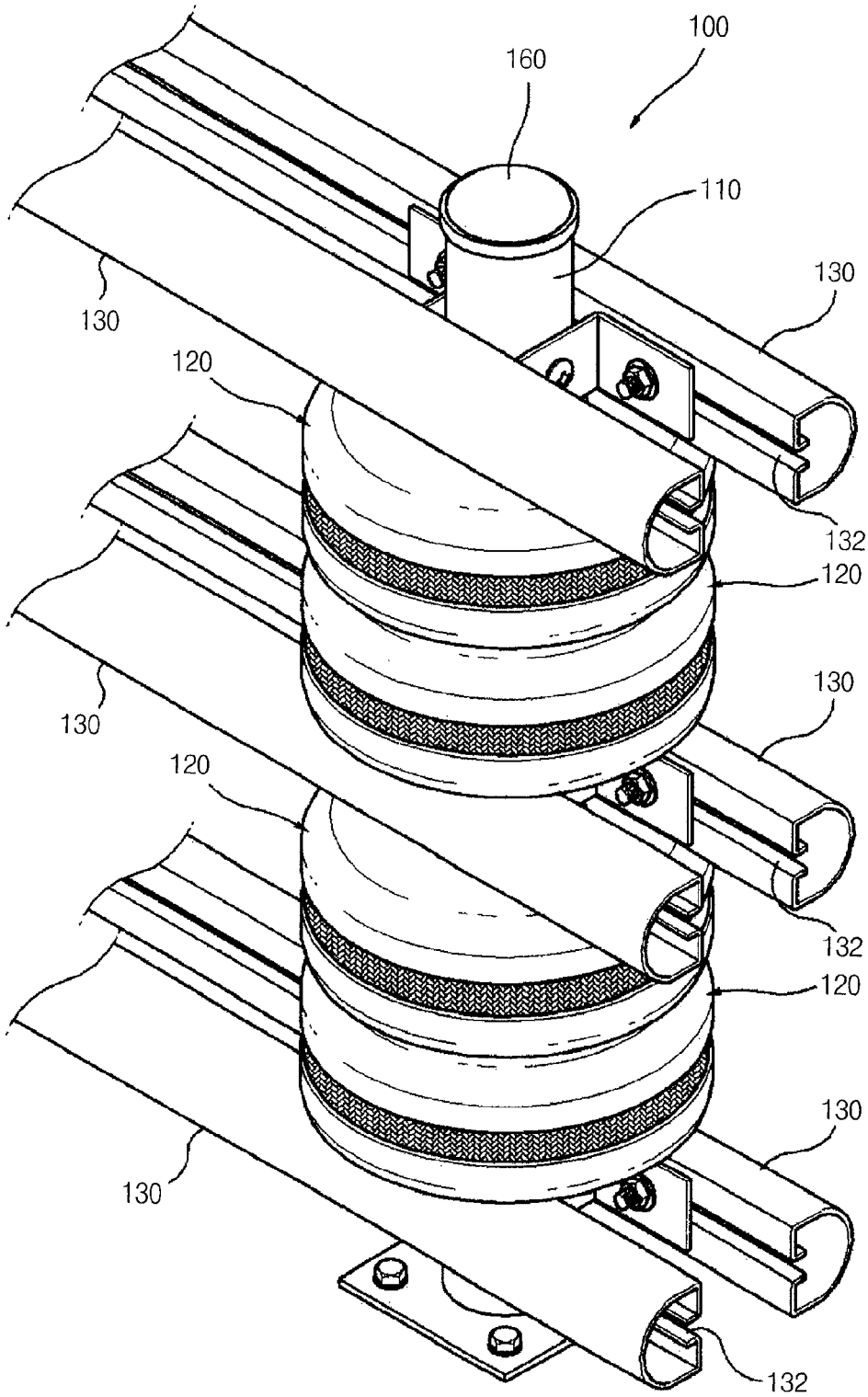
FIG. 2 is a perspective view of the impact absorbing barrier assembly in a combined state according to an embodiment of the present invention.
Figure 3:
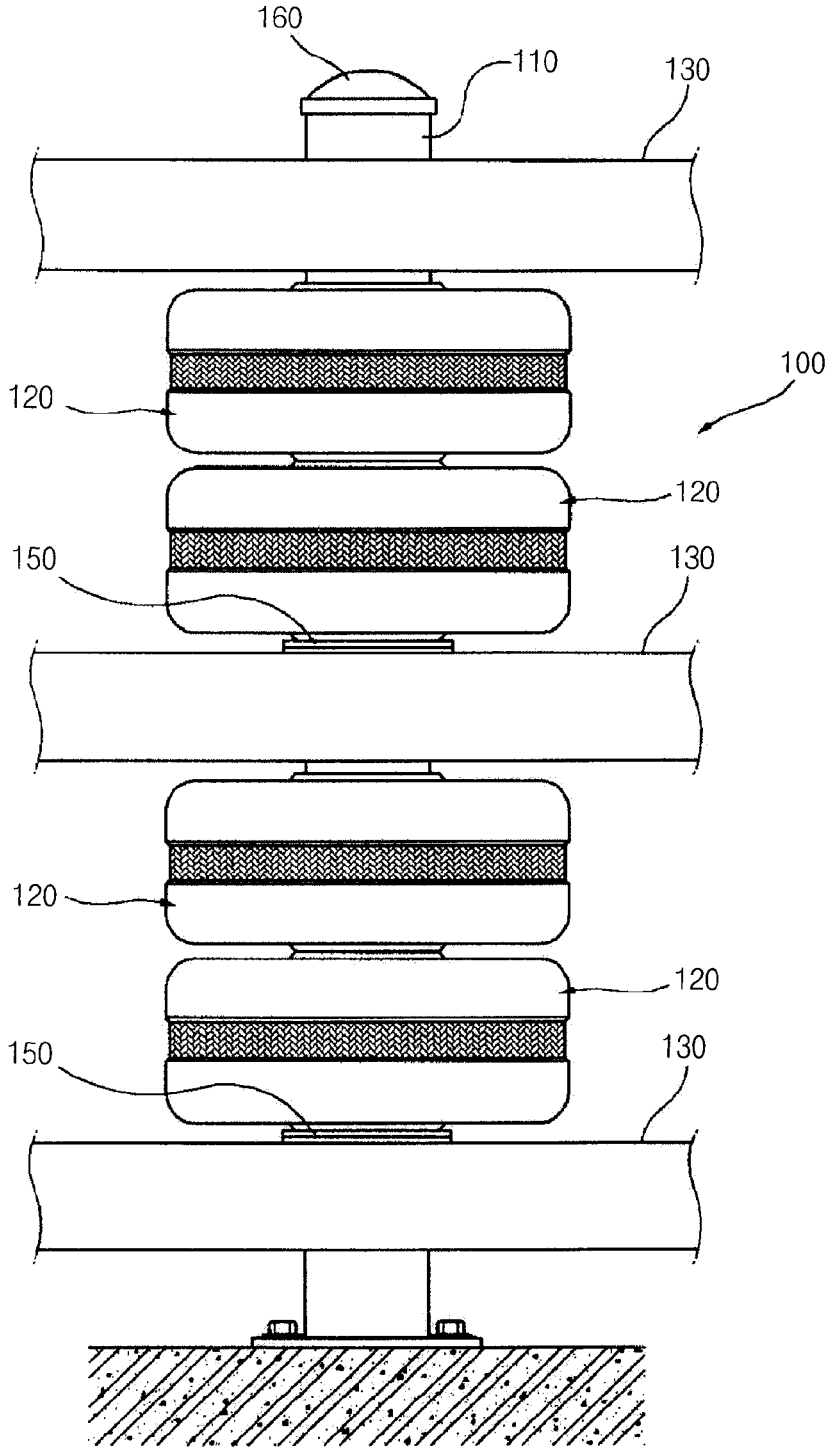
FIG. 3 is a front view of the impact absorbing barrier assembly according to an embodiment of the present invention.
Figure 4:
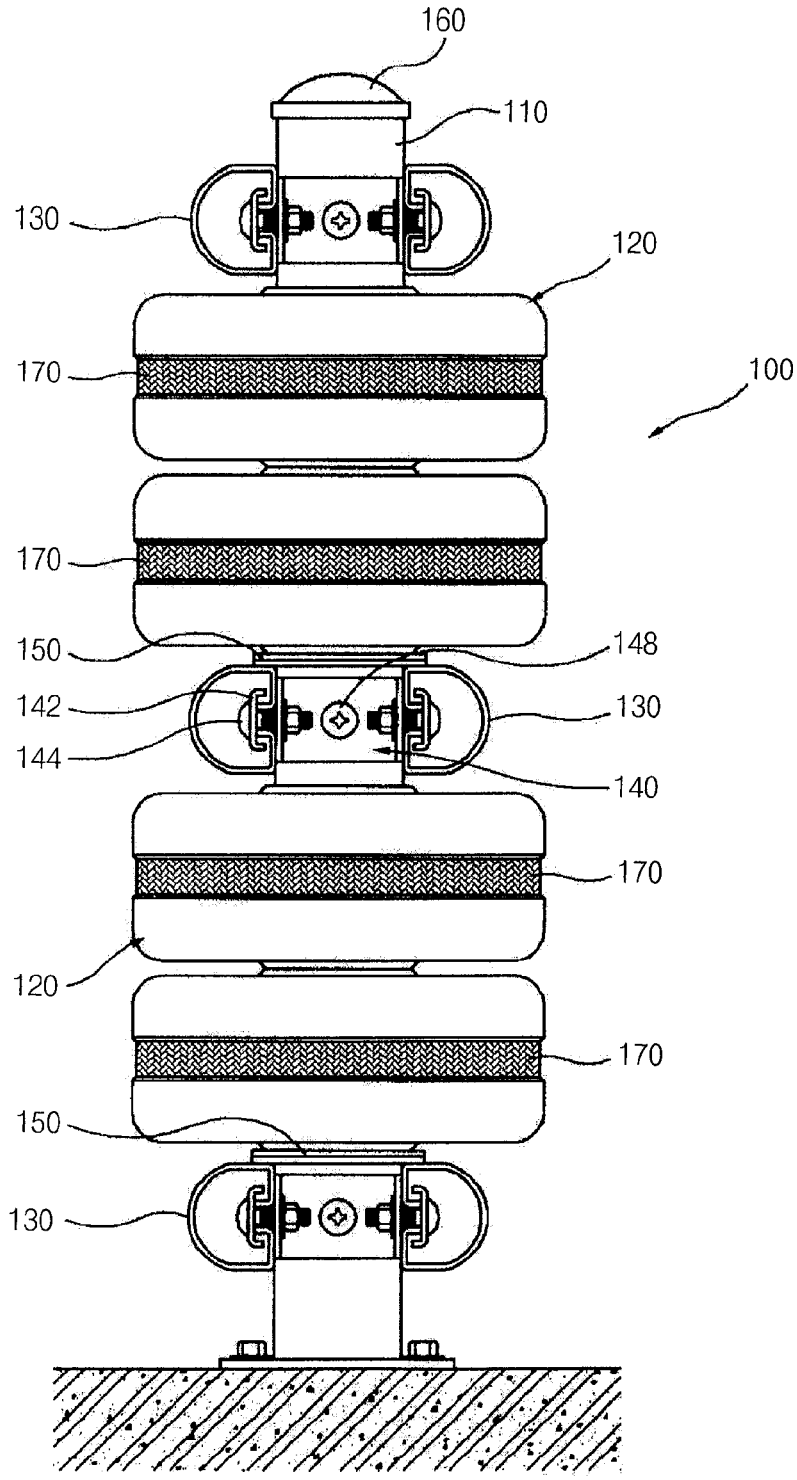
FIG. 4 is a side view of the impact absorbing barrier assembly according to an embodiment of the present invention.
Figure 5:
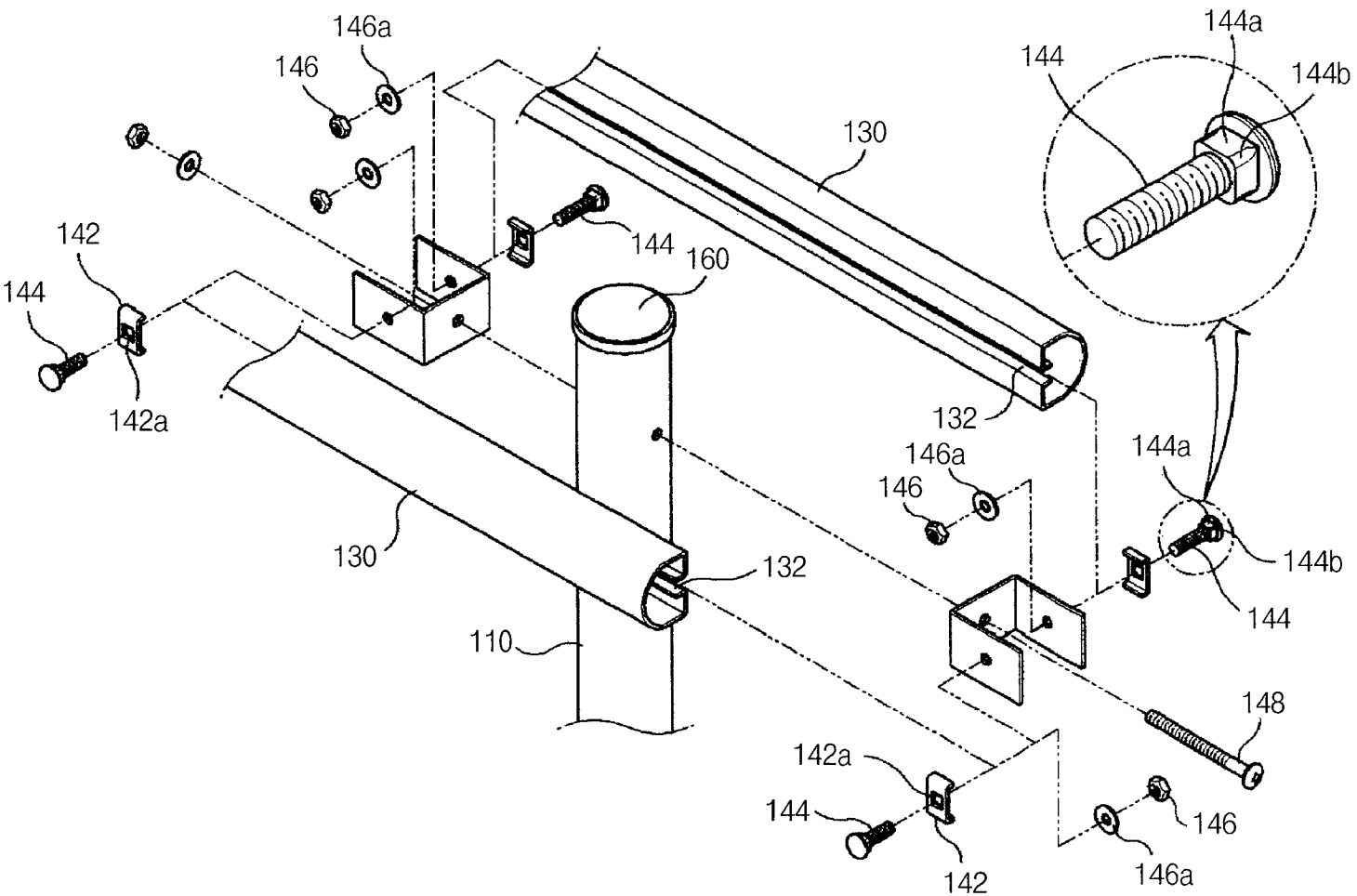
FIG. 5 is an exploded perspective view for illustrating a combining method of a safety fence of the impact absorbing barrier assembly according to an embodiment of the present invention.
Figure 6:
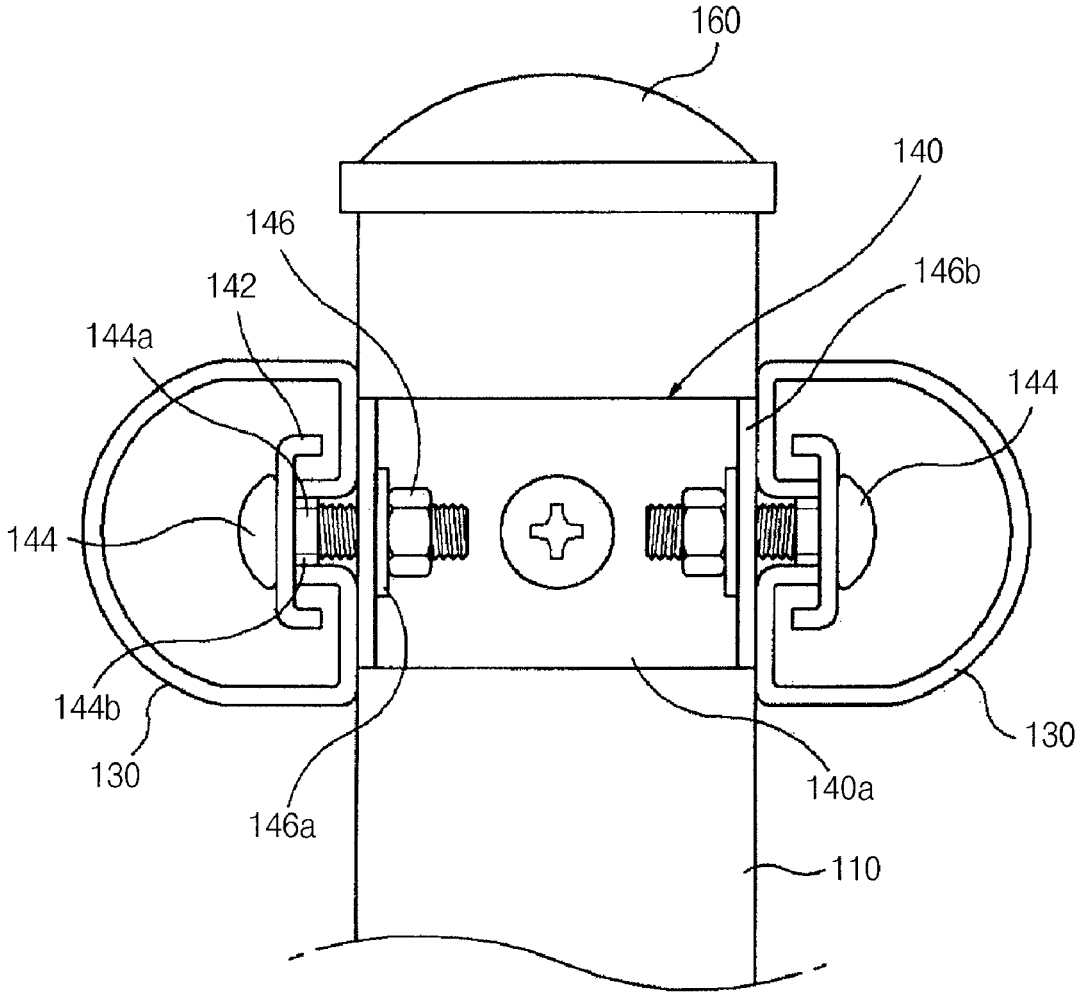
FIG. 6 is a side cross-sectional view of the impact absorbing barrier assembly illustrated in FIG. 5.
Figure 7:
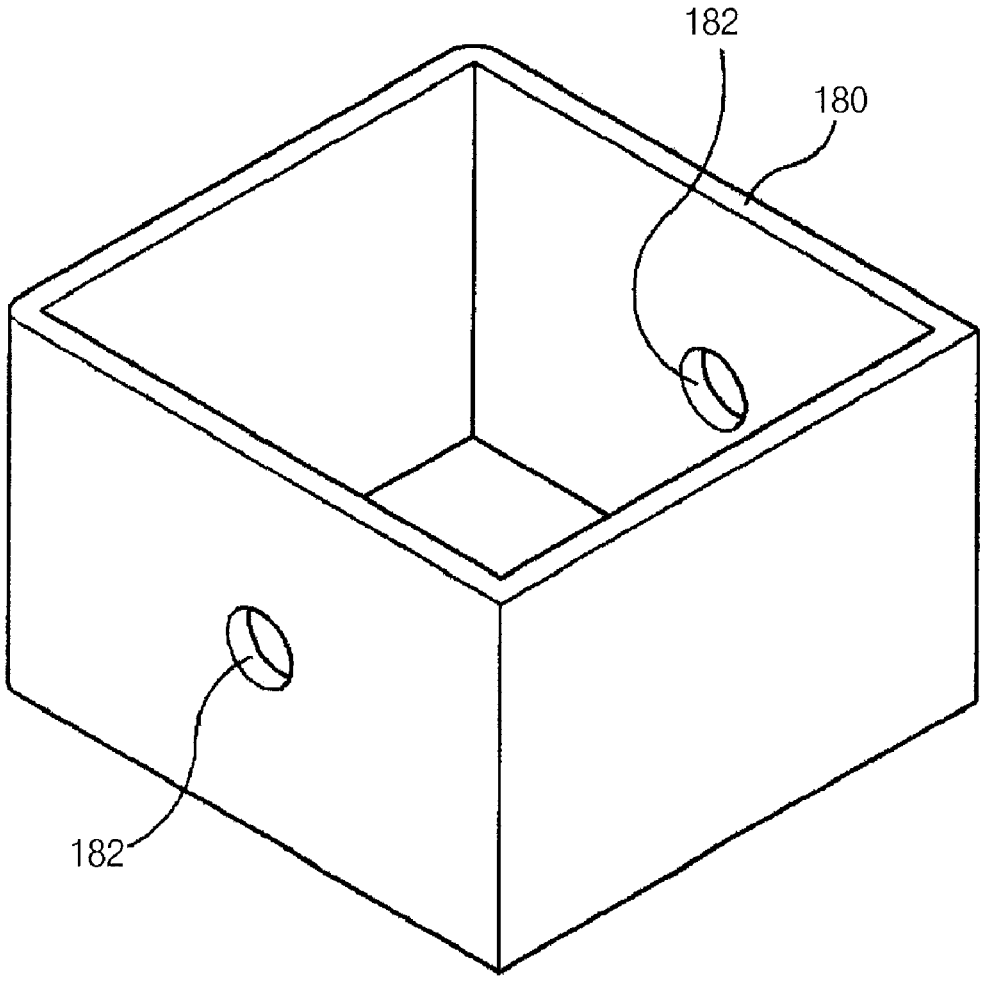
FIG. 7 is a perspective view of an impact absorbing cylinder of the impact absorbing barrier assembly according to an embodiment of the present invention.
Figure 8:
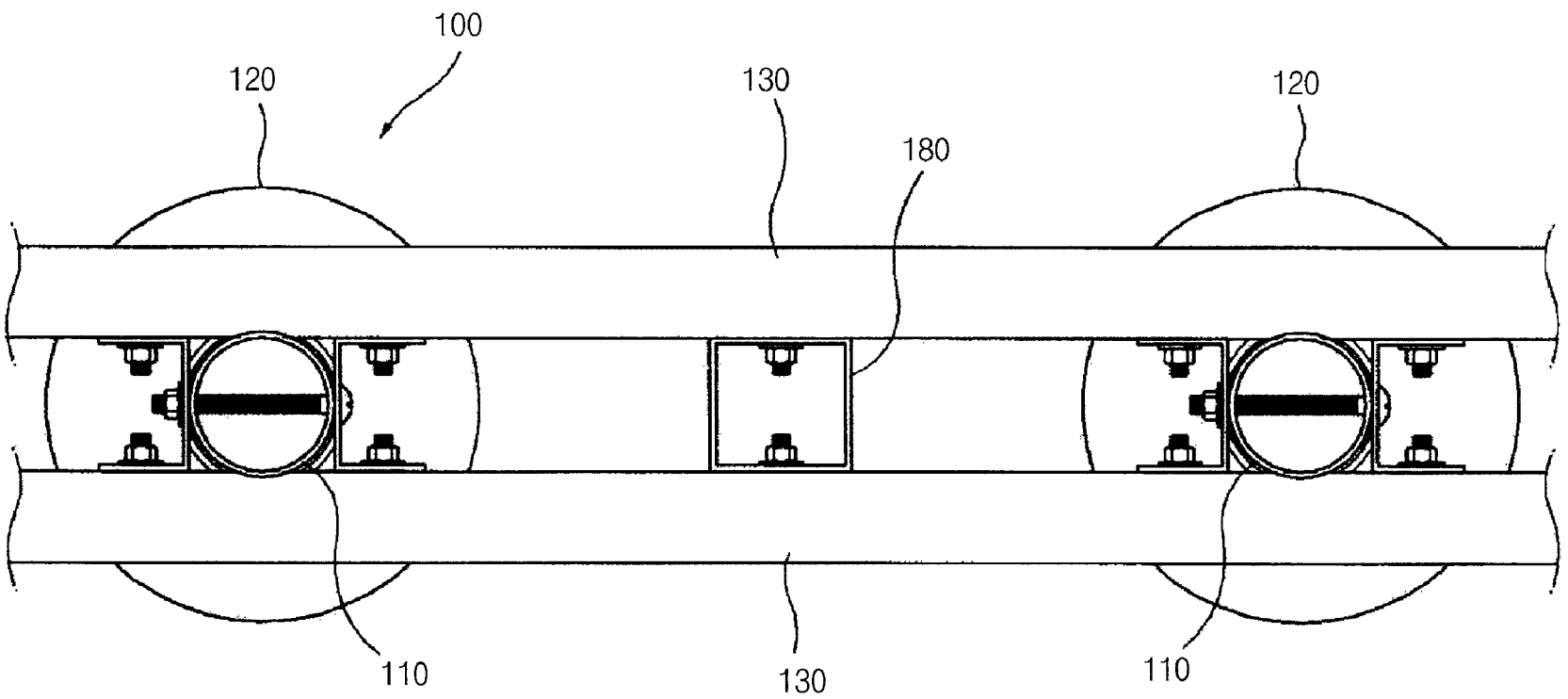
FIG. 8 is a plan view of the installed state of the impact absorbing cylinder illustrated in FIG. 7 into the impact absorbing barrier assembly according to an embodiment of the present invention.
Figure 9:
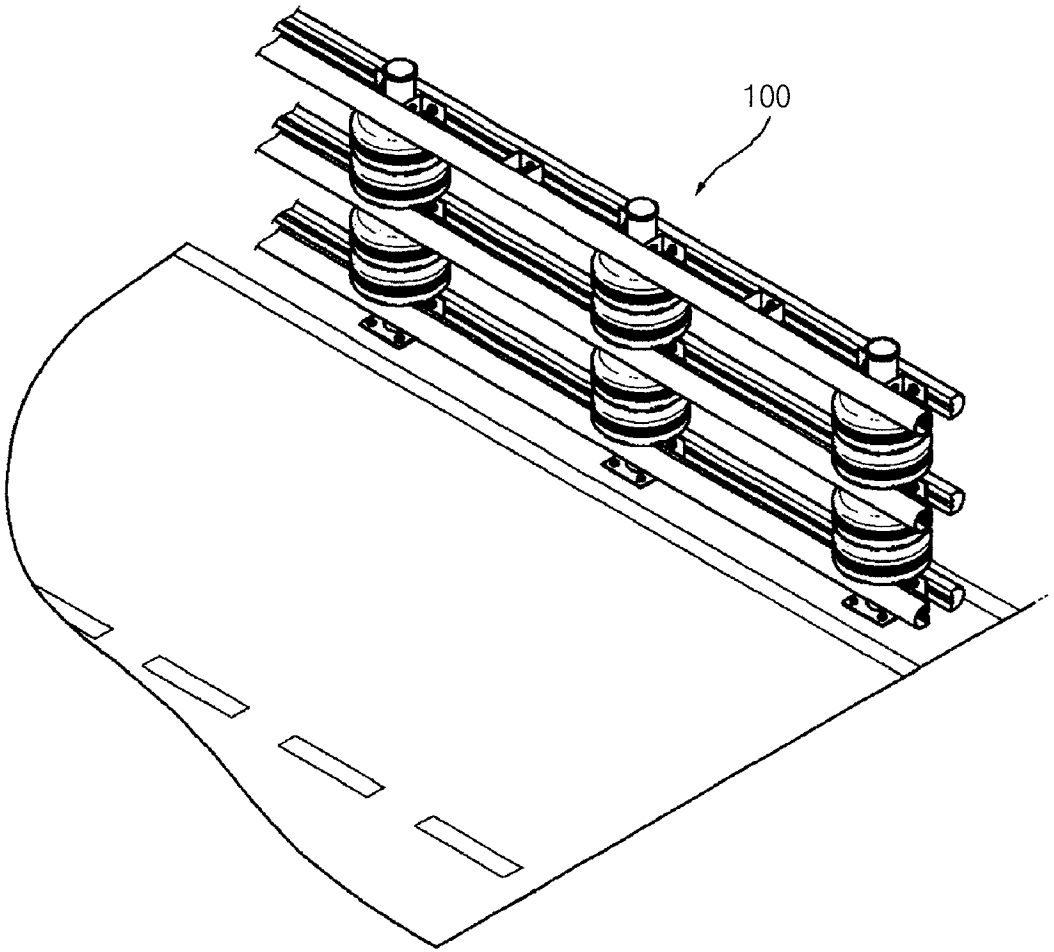
FIG. 9 is a perspective view of the installed impact absorbing barrier assembly according to an embodiment of the present invention.

FIG. 1 is an exploded perspective view of the impact absorbing barrier assembly according to an embodiment of the present invention, FIG. 2 is a perspective view of the impact absorbing barrier assembly in a combined state according to an embodiment of the present invention, FIG. 3 is a front view of the impact absorbing barrier assembly according to an embodiment of the present invention, FIG. 4 is a side view of the impact absorbing barrier assembly according to an embodiment of the present invention, FIG. 5 is an exploded perspective view for illustrating a combining method of a safety fence of the impact absorbing barrier assembly according to an embodiment of the present invention, FIG. 6 is a side cross-sectional view of the impact absorbing barrier assembly illustrated in FIG. 5, FIG. 7 is a perspective view of an impact absorbing cylinder of the impact absorbing barrier assembly according to an embodiment of the present invention, FIG. 8 is a plan view of the installed state of the impact absorbing cylinder illustrated in FIG. 7 into the impact absorbing barrier assembly according to an embodiment of the present invention, and FIG. 9 is a perspective view of the installed impact absorbing barrier assembly according to an embodiment of the present invention.

Referring to FIGS. 1 to 9, an impact absorbing barrier assembly 100 according to an embodiment of the present invention includes a support 110 fixed through burying at the center line or the side of a road at constant intervals, an impact absorbing cylinder 120 combined to the support 110 that rotates to absorb the impact induced from a car collision with the impact absorbing barrier assembly 100 and for returning the car to a normal forward direction, a fence guide 130 installed horizontally at the upper and lower portions of the impact absorbing cylinder 120 and at the front and rear portions of the support 110 to connect the supports 110, to support the impact absorbing cylinder 120 and to prevent separation of the impact absorbing cylinder 120, a fence guide combining device for combining the fence guide 130 at the front and rear portions of the support 110, a rotation support device of the impact absorbing cylinder inserted onto the outer circumference thereof to support the rotation of the impact absorbing cylinder 120 and an end cap 160 screw connected to the support 110 at the upper end portion thereof to close the upper end portion of the support 110.

The impact absorbing barrier assembly 100 having the above-described configuration according to an embodiment of the present invention is installed at the center line or the side of a road to absorb the impact from a car collision with the impact absorbing barrier assembly 100 by means of the elasticity of the impact absorbing cylinder 120 and to disperse and reduce the impact throughout the impact absorbing barrier assembly 100. Meanwhile, the impact from a car collision may be reduced through the rotation of the impact absorbing barrier assembly and the direction of the car is returned to a normal forward direction.

The cross-sectional view of the fence guide 130 of the impact absorbing barrier assembly 100 according to the above-described embodiment of the present invention has a semicircle structure as illustrated in FIGS. 1, 2 and 4 to 6. The long and facing end portions of the longitudinal inner portion of the fence guide 130 along the length, the portion facing the front and rear portions of the support 110, are bent into the inner portion of the fence guide 130 to form a longitudinal bolt insertion groove 132. The two end portions of the fence guide 130 are open.

The cross-sectional view of the fence guide 130 looks like a semicircle or a capital letter "D" as illustrated in FIGS. 1, 2 and 4 to 6. The long end portions at the center line of the fence guide 130 of the inner portion of the fence guide 130 facing the front and rear portions of the support 110 are bent at constant intervals to form the longitudinal bolt insertion groove 132, into which a fence guide combining bolt 144 may be inserted from the end portion of the fence guide 130.

The fence guide combining device of the impact absorbing barrier assembly 100 according to the present invention includes a fence guide support member 140 having a combining plate 140*a* having a predetermined length and a combining hole 140*a*-1 and combined to each face of the support 110 through a bolt nut member 148, and a pair of support plates 140*b* having a cantilever shape and formed at both end portions of the combining plate 140*a* in one body with a bolt combining hole 140*b*-1 at each support plate 140*b*, a bolt support plate 142 covering the both inner end portions of the fence guide 130 and having a bolt insertion hole 142*a* at the corresponding surface of the bolt insertion groove 132 of the fence guide 130, a fence guide combining bolt 144 for combining the fence guide 130 and the fence guide support member 140 from the inner portion of the fence guide 130 through the bolt insertion hole 142*a* of the bolt support plate 142 and the bolt combining hole 140*b*-1 formed on the support plate 140*b* of the fence guide support member 140 and a fence guide combining nut 146 for fixing the fence guide 130 on the fence guide support member 140 by screwing onto the fence guide combining bolt 144 penetrating from the inner portion of support plate 140*b* of the fence guide support member 140.

Meanwhile, the fence guide combining device is combined as follows. First, the fence guide support member 140 is fixed at both sides of the support 110 through the bolt nut member 148, and then the fence guide combining bolt 144 is screwed through the bolt insertion hole 142*a* of the bolt support plate 142. Then, the fence guide combining bolt 144 is inserted into the bolt insertion groove 132 of the fence guide 130. At this time, the bolt support plate 142 is combined so that the bolt support plate 142 covers both of the inner portions of the fence guide 130. After that, the fence guide combining bolt 144 is inserted and combined through the bolt combining hole 140*b*-1 formed on the support plate 140*b* of the fence guide support member 140. The fixing of the fence guide 130 is completed through combining with the fence guide combining nut 146. Of course, separation of the fence guide combining nut 146 may be prevented by using a washer 146*a* when combining the fence guide combining nut 146.

The assembly and disassembly by an operator of the above-explained fence guide combining device including the fence guide support member 140, the bolt support plate 142, the combining bolt 144 and the combining nut 146, may be easy and the substitution of the fence guide 130 may be an easy task when the fence guide 130 is broken by a car collision or other impact. In addition, assembly of the fence guide combining device having the above-described configuration may be easy when installing the impact absorbing barrier assembly 100.

The shape of the bolt insertion hole 142*b* of the bolt support plate 142 may have a square shape corresponding to the fence guide combining bolt 144 of the fence guide combining device as illustrated in FIGS. 1 to 5. The bolt insertion hole 142*b* of the bolt support plate 142 is formed to have a square shape to prevent the rotation of the fence guide combining bolt 144 during combining with the fence guide combining nut 146 through combining the bolt insertion hole 142*b* with a rotation preventing combining member 144*a* having a square shape and formed under the head portion of the fence guide combining bolt 144.

In the fence guide combining device described above, the rotation preventing combining member 144*a* formed beneath the bolt head of the fence guide combining bolt 144 has a square shape corresponding to the shape of the bolt insertion hole 142*b* of the bolt support plate 142 having a square shape. Further, the structure of the rotation preventing combining member 144*a* of the fence guide combining bolt 144 also corresponds to the bolt insertion groove 132 of the fence guide 130. That is, since the bolt insertion groove 132 of the fence guide 130 makes a square-shaped long groove, the rotation of the fence guide combining bolt 144 may be prevented during the insertion of the rotation preventing combining member 144*a* of the fence guide combining bolt 144 into the bolt insertion groove 132 of the fence guide 130.

At each edge portion of the rotation preventing combining member 144*a* of the fence guide combining bolt 144 having the configuration described above, an edge cut 144*b* is formed for easy combining while the fence guide combining bolt 144 is screwed through the bolt insertion hole 142*a* of the bolt support plate 142. That is, the insertion and combination of the fence guide combining bolt 144 may be easy without generating a blocking portion when the fence guide combining bolt 144 is inserted into the bolt insertion hole 142*a* of the support plate 142 having the square shape because of the edge cut 144*b*.

Figure 10:
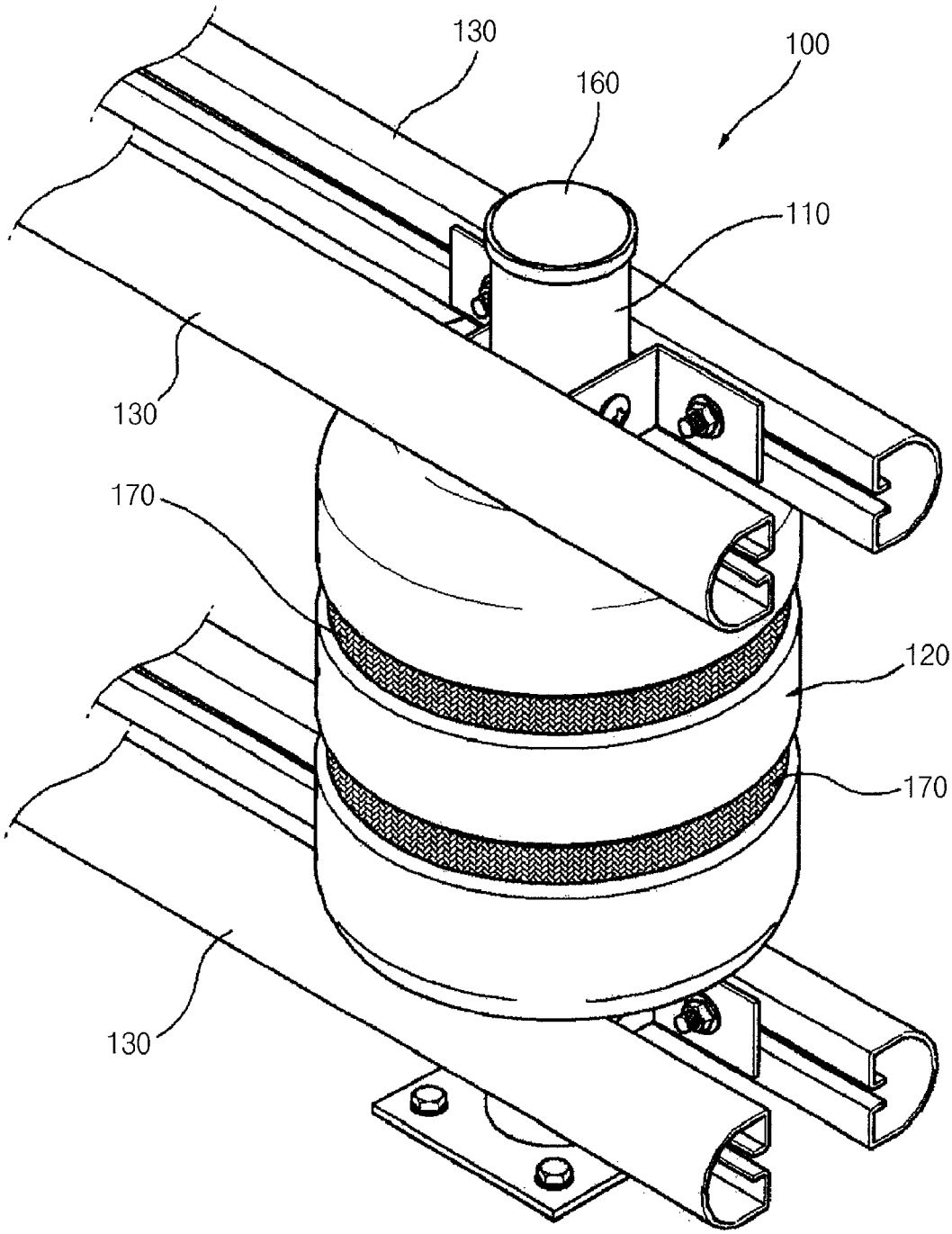
FIG. 10 is a perspective view of the impact absorbing barrier assembly having another type of the impact absorbing cylinder according to another embodiment of the present invention.
Figure 11:
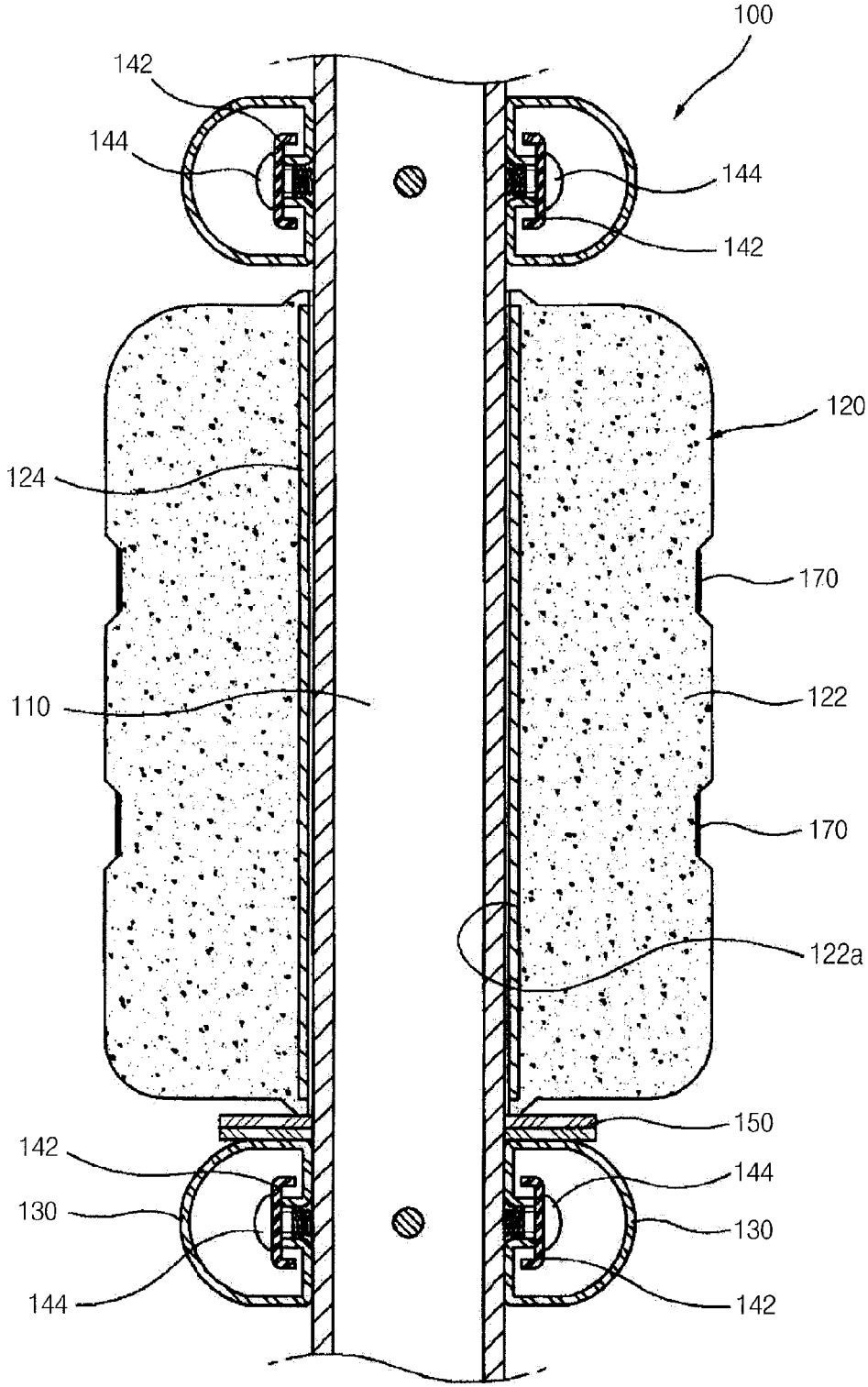
FIG. 11 is a cross-sectional view of the impact absorbing barrier assembly illustrated in FIG. 10.
Figure 12:
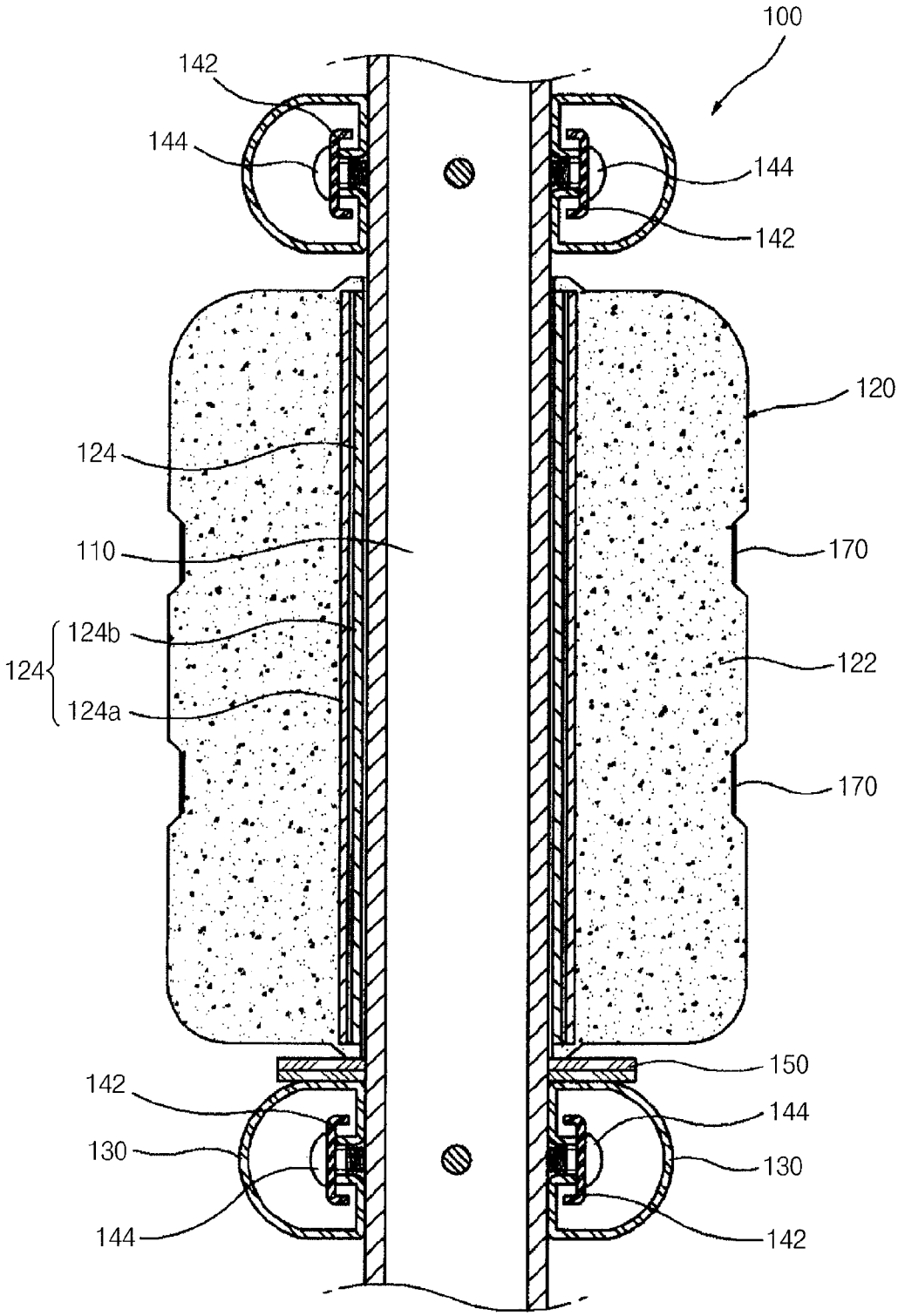
FIG. 12 is a perspective view of the impact absorbing barrier assembly having further another type of the impact absorbing cylinder according to a further another embodiment of the present invention.

According to the present invention, the impact absorbing cylinder 120 of the impact absorbing barrier assembly 100 is combined to the support 110 and may be formed in various types including one rotatable shape or a plurality of elements having different heights as illustrated in FIGS. 10 to 12 or in FIGS. 1 to 4. That is, the impact absorbing cylinder 120 might be formed as one large type and rotationally combined with the support 110 as illustrated in FIGS. 10 to 12, or the impact absorbing cylinder 120 might be formed as a plurality of cylinders and rotationally combined with the support 110 as illustrated in FIGS. 1 to 4.

The selection of the type of the impact absorbing cylinder 120 rotationally combined to the support 110 as the one large type as illustrated in FIGS. 10 to 12 or the plurality type having different sizes as illustrated in FIGS. 1 to 4 enables the installation of the impact absorbing barrier assembly 100 appropriate to the condition of the road structure. Further, an installation of the impact absorbing barrier assembly appropriate to the surroundings may also be accomplished.

As described above, when a plurality of the impact absorbing cylinders 120 having different sizes is installed as illustrated in FIGS. 1 to 4, the fence guide 130 is installed at the upper, middle and lower portions of the support 110 to separate the plurality of the impact absorbing cylinders 120 between the fence guides 130. When one large-size impact absorbing cylinder 120 is installed as illustrated in FIGS. 10 to 12, the fence guide 130 is installed at the upper and lower portions of the impact absorbing cylinder 120.

The configuration of the impact absorbing barrier assembly according to the present invention will be described in more detail hereinafter. First, the support 110 is installed to rotationally support the impact absorbing cylinder 120 and the support 110 is installed upright perpendicular to the ground at the center line or the side of the road as illustrated in FIGS. 1 to 4 at constant intervals.

The support 110 may be formed as a hollow pipe and a lower end portion of the support 110 is buried in the ground or may be installed upright by means of a special fixing device at the center line or the side of the road at constant intervals. At this time, the hollow portion of the support 110 may be filled with concrete mortar to reinforce the strength of the support 110.

The impact absorbing cylinder 120 constituting the impact absorbing barrier assembly 100 according to the present invention, absorbs and disperses the impact from a car collision with the impact absorbing barrier assembly 100 to reduce the impact. The impact absorbing cylinder 120 is rotationally combined to the support 110 as illustrated in FIGS. 1 to 4 and includes a cylinder 122 being made by using ethylene vinyl acetate (EVA) or soft polyurethane and having a through-hole 122*a* from the top to the bottom and a rotation support pipe 124 made by using synthetic resin and having a pipe shape corresponding to the outer circumference of the support 110 for inserting by force into the through-hole 122*a* of the cylinder 122.

The impact absorbing cylinder 120 having the above described configuration is obtained by inserting and combining the hollow rotation support pipe 124 by force into the through-hole 122*a* of the cylinder 122 molded by using EVA or soft polyurethane. Since the elasticity of EVA or soft polyurethane is excellent, the rotation support pipe 124 may be firmly fixed and not be separated from the through-hole 122*a* of the cylinder 122 after inserting the rotation support pipe 124 into the through-hole 122*a* of the cylinder 122.

As described above, one type impact absorbing cylinder 120 may be rotationally combined to the support 110 as illustrated in FIGS. 10 to 12 or a plurality of the impact absorbing cylinders 120 having different heights may be rotationally combined to the support 110 as illustrated in FIGS. 1 to 4. At this time, a fluorescent material might be included in the EVA or soft polyurethane during molding the impact absorbing cylinder 120, so as to emit light at night for better visibility of the impact absorbing barrier assembly 100 by a driver.

On the outside circumference of the impact absorbing cylinder 120, a high-luminance reflective sheet 170, which reflects the light of a car at night, might be further provided for better visibility of a traffic lane at night by improving the visibility of the impact absorbing barrier assembly 100. The high-luminance reflective sheet 170 improves the driver's visibility of the impact absorbing barrier assembly 100 at night to enable even safer driving.

The fence guide 130 constituting the impact absorbing barrier assembly 100 according to the present invention is provided to connect and reinforce the support 110 installed at constant intervals and to support the impact absorbing cylinder 120 to a predetermined height of the support 110. This fence guide 130 is horizontally installed at the front and rear portions and at the upper and lower portions of the impact absorbing cylinder 120 as illustrated in FIGS. 1 to 4 to connect the support 110.

The fence guide 130 provided at the lower portion of the impact absorbing cylinder 120 supports the impact absorbing cylinder 120, while the fence guide 130 provided at the upper portion of the impact absorbing cylinder 120 prevents separation of the impact absorbing cylinder 120 from the support 110. When one cylinder type impact absorbing cylinder 120 is utilized as illustrated in FIGS. 10 to 12, the fence guide 130 is provided at the upper and lower portions of the impact absorbing cylinder 120, and when a plurality cylinder type impact absorbing cylinder 120 having different sizes is utilized as illustrated in FIGS. 1 to 9, the fence guide 130 is provided at the upper, middle and lower portions of the support 110 so that a plurality of the impact absorbing cylinders 120 may be installed separately between the fence guides 130.

The fence guide combining device constituting the impact absorbing barrier assembly 100 according to the present invention is utilized to install and fix the fence guide 130 at the front and rear portions of the support 110. The fence guide combining device has a prefabricated structure as described above and installation of the impact absorbing barrier assembly 100 may be easy. In advance, disassembly of the impact absorbing barrier assembly 100 may also be easy and replacement work may become an easy task.

The rotation support device of the impact absorbing cylinder constituting the impact absorbing barrier assembly 100 according to the present invention enables smooth rotation of the impact absorbing cylinder 120 on the support 110. This rotation support device of the impact absorbing cylinder is inserted onto the outside circumference of the support 110 between the fence guide 130 and the impact absorbing cylinder 120 to support the rotation of the impact absorbing cylinder as illustrated in FIGS. 1 to 4. The rotation support device of the impact absorbing cylinder inserted onto the outside circumference of the support 110 between the fence guide 130 and the impact absorbing cylinder 120, is supported at the upper surface portion of the fence guide 130.

The rotation support device of the impact absorbing cylinder inserted onto the outside circumference of the support 110 between the fence guide 130 and the impact absorbing cylinder 120 might be a plurality of rings or bearings 150 rotationally combined onto the outside circumference of the support 110. Two rings 150 are utilized as the rotation support device of the impact absorbing cylinder in the embodiment illustrated in FIGS. 1 to 4 according to the present invention.

The ring or bearing 150 as the rotation support device of the impact absorbing cylinder to rotationally support the impact absorbing cylinder 120, and inserted onto the outside circumference of the support 110 between the fence guide 130 and the impact absorbing cylinder 120, allows the impact absorbing cylinder 120 to smoothly rotate after the application of the impact from a car collision or other impact with the impact absorbing cylinder 120. Because of the smooth rotation of the impact absorbing cylinder 120, the car delivering the impact may return to a normal forward direction.

The end cap 160 constituting the impact absorbing barrier assembly 100 according to the present invention is provided to close the upper end portion of the support 100. The end cap 160 is combined to the upper end portion of the hollow support 110 as illustrated in FIGS. 1 to 4 to cover the upper end portion of the hollow support 110 and prevent the corrosion of the support 110 due to pooling of rainwater, etc. in the hollow of the support 110.

In addition to the above-described constituents of the impact absorbing barrier assembly 100 according to the present invention as described above, a fence guide reinforcing member 180 is may be further installed to reinforce the connection of the fence guide 130 at the center portion of the fence guide 130 between two supports 110. The fence guide reinforcing member 180 is provided between two front and rear fence guides 130 between two supports 110, to connect the two fence guides 130 and reinforce the fence guides 130 and disperse an impact applied to one fence guide 130 to the other fence guide 130 through the fence guide reinforcing member 180.

The fence guide reinforcing member 180 installed between two fence guides 130 between two supports 110 is a hexahedron shape corresponding to the interval between the two fence guides 130. At each surface of the reinforcing member 180 facing the fence guide 130, a bolt combining opening 182 is formed and the reinforcing member 180 is combined to the fence guide 130 by a fence guide combining device inserted along the bolt insertion groove 132 of the fence guide 130 and through the bolt combining opening 182 of the fence guide reinforcing member 180. Here, a separate explanation on the fence guide combining device will be omitted because it was described hereinbefore.

FIG. 10 is a perspective view of the impact absorbing barrier assembly having another type of the impact absorbing cylinder according to another embodiment of the present invention, FIG. 11 is a cross-sectional view of the impact absorbing barrier assembly illustrated in FIG. 10.

The impact absorbing barrier assembly 100 illustrated in FIGS. 10 and 11 includes one large-size impact absorbing cylinder 120 when comparing with the plurality of the impact absorbing cylinders 120 illustrated in FIGS. 1 to 9. Both examples of the impact absorbing cylinder 120 illustrated in FIGS. 10 and 11 and FIGS. 1 to 9 include a cylinder 122 made by using EVA or soft polyurethane and having a through-hole 122*a* from the upper to the bottom portions thereof, and a hollow rotation support pipe 124 having a pipe configuration corresponding to the outside circumference of the support 110 and inserted by force into the through-hole 122*a* of the cylinder 122 as described above.

The impact absorbing cylinder 120 illustrated in FIGS. 10 and 11 also includes the cylinder 122 and the rotation support pipe 124 as in the impact absorbing cylinder 120 illustrated in FIGS. 1 to 9, and the rotation support pipe 124 is rotationally combined to the support 110 through the hollow of the rotation support pipe 124. At this time, the impact absorbing cylinder 120 illustrated in FIGS. 10 and 11 may also be provided with a high-luminance reflective sheet 170 on the outside circumference of the impact absorbing cylinder 120 to improve the visibility of a traffic lane through reflecting the light of a car at night like the impact absorbing cylinder 120 illustrated in FIGS. 1 to 9.

When one large-sized cylinder type impact absorbing cylinder 120 is installed as illustrated in FIGS. 10 to 12, the fence guide 130 is provided at the upper and lower portions of the impact absorbing cylinder 120. Among the fence guides 130 provided at the upper and lower portions of the impact absorbing cylinder 120, the fence guide 130 at the lower portion supports the impact absorbing cylinder 120 and the fence guide 130 at the upper portion prevents separation of the impact absorbing cylinder 120 from the support 110.

FIG. 12 is a perspective view of the impact absorbing barrier assembly having further another type of the impact absorbing cylinder according to a further another embodiment of the present invention.

Referring to FIG. 12, the impact absorbing cylinder 120 of the impact absorbing barrier assembly 100 according to another embodiment of the present invention also includes a cylinder 122 having a through-hole 122*a* and being made by using EVA or soft polyurethane, and a rotation support pipe 124 having a pipe configuration corresponding to the outside circumference of the support 110 and inserted by force into the through-hole 122*a* of the cylinder 122, like the impact absorbing cylinder 120 illustrated in FIGS. 1 to 9 according to one embodiment and the impact absorbing cylinder 120 illustrated in FIGS. 10 and 11 according to another embodiment.

Differently, the impact absorbing cylinder 120 illustrated in FIG. 12 includes the rotation support pipe 124 having an outer rotation support pipe 124*a* and an inner rotation support pipe 124*b*. At this time, the inner rotation support pipe 124*b* is rotationally installed with respect to the outer rotation support pipe 124*a* and the inside diameter of the inner rotation support pipe 124*b* is formed in correspondence to the outer diameter of the support 110.

The assembly process of the impact absorbing barrier assembly 100 according to the present invention will hereinafter be described in detail. First, the support 110 having a constant height is installed and fixed at the center line or the side of a road at constant intervals, and then a fence guide 130 is combined and fixed in front and rear portions of the support 110 at a predetermined height from the lower bottom portion of the support 110 by means of a fence guide combining device.

After combining and fixing the fence guide 130 at the front and rear portions of the support 110 and at the predetermined height from the lower bottom portion of the support 110 by means of a fence guide combining device as described above, the ring or bearing 150, as the rotation support device of the impact absorbing cylinder, is screwed on the upper surface portion of the ready installed fence guide 130 through the upper portion of the support 110.

After screwing the ring or bearing 150, as the rotation support device of the impact absorbing cylinder, on the outer circumference of the support 110, the impact absorbing cylinder 120 is rotationally combined to the support 110. At this time, the impact absorbing cylinder 120 rotationally combined on the outer circumference of the support 110 is positioned on the ring or bearing 150 as the rotation support device of the impact absorbing cylinder.

When the impact absorbing cylinder 120 is rotationally combined to the outside circumference of the support 110 as described above, a plurality of impact absorbing cylinders 120 having different sizes may be installed as illustrated in FIGS. 1 to 9 and a large-sized one impact absorbing cylinder 120 may be installed as illustrated in FIGS. 10 to 12. When a plurality of the impact absorbing cylinders 120 having different sizes are installed as illustrated in FIGS. 1 to 9, an additional fence guide 130 may be provided between the impact absorbing cylinders 120 to separate the plurality of the impact absorbing cylinders 120 into upper and lower impact absorbing cylinders 120.

After rotationally combining the impact absorbing cylinder 120 onto the outside circumference of the support 110 as described above, the fence guide 130 is combined and fixed at the front and rear portions of the support 110 and at the upper portion of the impact absorbing cylinder 120 by using the fence guide combining device. The end cap 160 is covered to close the upper end portion of the support 110.

INDUSTRIAL APPLICABILITY

According to the embodiments of the present invention, the impact absorbing barrier assembly may reduce the impact from a car collision with the impact absorbing barrier assembly and prevent intrusion of a car into the oncoming lanes by crossing the center line or a car from leaving the road. In addition, the car may be returned to a normal forward direction to minimize the dangerousness of a serious accident. Since the impact absorbing cylinder for absorbing and reducing the impact from a car collision, is made by using EVA or soft polyurethane, and EVA and soft polyurethane has excellent recovery properties and elasticity, breaking of the impact absorbing cylinder after a car collision may be prevented to save costs for maintenance and repair. Further, the structure of the impact absorbing barrier assembly of the present invention has a prefabrication structure and broken portions after a car collision may be easily replaced and the management thereof may be an easy task.

While the present invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims.

The invention claimed is:

1. An impact absorbing barrier assembly comprising:

a plurality of supports having a pipe configuration;

a plurality of impact absorbing cylinders, each impact absorbing cylinder having a through-hole penetrating from an upper portion to a bottom portion thereof, rotationally coupled to a corresponding one of the plurality of supports, comprising one of Ethylene Vinyl Acetate and soft polyurethane, and including a rotation support pipe having a pipe configuration corresponding to an outer circumference of the corresponding support and located in the through-hole of each impact absorbing cylinder;

a first pair of fence guides horizontally installed at front and rear portions of each support above each impact absorbing cylinder so as to face each other and a second pair of fence guides horizontally installed at front and rear portions of each support below each impact absorbing cylinder so as to face each other for supporting and preventing separation of each impact absorbing cylinder;

at least one fence guide combining device coupled with at least one of the first pair of fence guides and the second pair of fence guides;

at least one rotation support device for each impact absorbing cylinder, located on the outer circumference of each support between the second pair of fence guides and each impact absorbing cylinder to support rotation of each impact absorbing cylinder; and at least one fence guide reinforcing member coupled with at least one of the first pair of fence guides and the second pair of fence guides and located between two supports to reinforce a connection of the at least one of the first pair of fence guides and the second pair of fence guides, the at least one fence guide reinforcing member having a hexahedron shape corresponding to a distance between the at least one of the first pair of fence guides and the second pair of fence guides, and a bolt combining opening being formed at each side facing the at least one of the first pair of fence guides and the second pair of fence guides for combining using the at least one fence guide combining device inserted into the bolt combining opening of the at least one fence guide reinforcing member through a long bolt insertion groove of the first pair of fence guides and the second pair of fence guides.

2. The impact absorbing barrier assembly of claim 1, wherein a cross-section of the first pair of fence guides and the second pair of fence guides has a semicircle configuration and the long bolt insertion groove is formed along a central line of a plane facing each support, both long end portions being separated at constant intervals and bent inwards.

3. The impact absorbing barrier assembly of claim 2, wherein the at least one fence guide combining device comprises:

at least one fence guide support member including a combining plate having a combining hole at a center portion thereof and having a predetermined length to combine the fence guide support member to both sides of each support through a bolt nut member, and each fence guide support member including a pair of support plates formed at both sides of the combining plate in one body, a bolt combining hole being formed at each pair of the support plates;

at least one bolt support plate having a configuration of covering both inner end portions of the first pair of fence guides and the second pair of fence guides and having a bolt insertion hole at a surface corresponding to the long bolt insertion groove of the first pair of fence guides and the second pair of fence guides;

at least one fence guide combining bolt combined through the bolt insertion hole of the at least one bolt support plate and the bolt combining hole formed on the pair of the support plates of the at least one fence guide support member at an inner portion of the first pair of fence guides and the second pair of fence guides; and at least one fence guide combining nut for fixing the first pair of fence guides and the second pair of fence guides onto the at least one fence guide support member by screwing onto the at least one fence guide combining bolt penetrating into the inner portion of the pair of the support plates of the at least one fence guide support member.

4. The impact absorbing barrier assembly of claim 3, wherein the bolt insertion hole of the at least one bolt support plate has a square shape corresponding to the long bolt insertion groove of the first pair of fence guides and the second pair of fence guides.

5. The impact absorbing barrier assembly of claim 4, further comprising at least one rotation preventing combining member having a square shape at a lower portion of a bolt head of the at least one fence guide combining bolt corresponding to the first pair of fence guides and the second pair of fence guides long bolt insertion groove, thereby preventing rotation through a rotation preventing function with the long bolt insertion groove through combining with the at least one fence guide combining nut.

6. The impact absorbing barrier assembly of claim 5, wherein an edge cut is formed at each edge portion of the at least one rotation preventing combining member of the at least one fence guide combining bolt when screwing the at least one fence guide combining bolt through the bolt insertion hole of the at least one bolt support plate.

7. The impact absorbing barrier assembly of claim 1, wherein the plurality of the impact absorbing cylinders having different heights are rotationally combined to the plurality of supports.

8. The impact absorbing barrier assembly of claim 7, wherein the first pair of fence guides is installed above the plurality of impact absorbing cylinders, while the first pair of fence guides, the second pair of fence guides, and a third pair of fence guides are installed at upper, middle and lower portions of each support, respectively, when the plurality of the impact absorbing cylinders having different sizes is installed, to separate the plurality of the impact absorbing cylinders from each other.

9. The impact absorbing barrier assembly of claim 8, further comprising a high-luminance reflective sheet on an outer surface of each impact absorbing cylinder for better visibility of a traffic lane through light reflection at night.

10. The impact absorbing barrier assembly of claim 8, wherein each impact absorbing cylinder is made by adding a fluorescent material into one of Ethylene Vinyl Acetate and soft polyurethane material to emit light at night.

11. The impact absorbing barrier assembly of claim 1, wherein the at least one rotation support device of the impact absorbing cylinder is one of a plurality of rings and bearings, rotationally combined on an outer circumference of the each support.

12. The impact absorbing barrier assembly of claim 1, wherein the rotation support pipe of each impact absorbing cylinder includes an outer rotation support pipe and an inner rotation support pipe, the inner rotation support pipe being rotationally installed with respect to the outer rotation support pipe.

* * * * *